US007543404B2

(12) United States Patent
Kovalchuk et al.

(10) Patent No.: US 7,543,404 B2
(45) Date of Patent: Jun. 9, 2009

(54) METHOD FOR LOADING A PISTOL AND A HOLSTER

(76) Inventors: Valeriy Adamovich Kovalchuk, ul.Bljukhera, 40, Chelyabinsk (RU) 454048; Vladimir Georgievich Lemehko, ul.Tatitanichevoi, 58-4, Chelyabinsk (RU) 454126; Evgeniv Eduardovich Yamschikov, ul.2-ya Arzamasskaya, 25-28, Chelyabinsk (RU) 45407; Gainan Gumaraovich Junusov, ul.Bljukhera, 40, Chelyabinsk (RU) 454048; Sergey Adamovitch Kovalchuk, Sverdlovsky pr-t, 23-14, Chelyabinsk (RU) 454008

( * ) Notice: Subject to any disclaimer, the term of this patent is extended or adjusted under 35 U.S.C. 154(b) by 0 days.

(21) Appl. No.: 10/541,334

(22) PCT Filed: Apr. 30, 2003

(86) PCT No.: PCT/RU03/00216

§ 371 (c)(1),
(2), (4) Date: Jul. 10, 2006

(87) PCT Pub. No.: WO2004/059238

PCT Pub. Date: Jul. 15, 2004

(65) Prior Publication Data

US 2007/0138219 A1 Jun. 21, 2007

(30) Foreign Application Priority Data

Dec. 30, 2002 (RU) ..... 2002135782

(51) Int. Cl.
*F41C 33/02* (2006.01)

(52) U.S. Cl. ..... 42/106; 42/85; 42/87; 42/90; 224/192; 224/193; 224/243; 224/912

(58) Field of Classification Search ..... 224/192, 224/193, 198, 143, 911, 912; D03/222, 223; 42/106

See application file for complete search history.

(56) References Cited

U.S. PATENT DOCUMENTS 3,550,822 A * 12/1970 Lloyd ..... 224/193

(Continued)

*Primary Examiner*—Bret Hayes

(57) ABSTRACT

The present invention relates to devices for carrying small arms. The inventive method provides for use of a holster having a slot for a pistol grip. When a pistol is straightwardly pushed in the holster, the safety-stop thereof is switched in armed position. The pistol is removable by the opposite displacement thereof. The body of the inventive holster comprises guides for a breechblock, a spring loaded lock thereof, and a unit for switching said breechbloc which is arranged on the sidewall of said body on the side of the safety-stop of the pistol and embodied in the form of a spring loaded fork. The lock is embodied in the form of a cantilever plate provided with an arrester which is mounted in such a way that it interacts with the breechblock and the indicator of the safety-stop when it is switched on. In the second variant, the switching means is embodied in the form of a shaped window which has a simple trapezium shape and is arranged on the sidewall of the body. The fixing means of the pistol is embodied in the form of a plate-like sprig-loaded lock arranged in such a way that it is divertable by the pistol when it is introduced into the holster, and can interact with the safety-stop indicator. A stop lug for the pistol receiver whose length is higher the maximum size of the shaped window, is embodied on the other wall of the body in the base thereof in such a way that it is symmetrical with respect to said shaped window.

10 Claims, 6 Drawing Sheets

U.S. PATENT DOCUMENTS 4,055,015 A * 10/1977 Musgrave ..... 42/106
4,138,044 A * 2/1979 Musgrave ..... 224/242
4,298,150 A * 11/1981 Seldeen ..... 224/243
4,377,249 A * 3/1983 Bockoven ..... 224/163
4,689,908 A * 9/1987 McClellan ..... 42/71.02
5,544,794 A * 8/1996 Nichols ..... 224/667
5,687,891 A * 11/1997 Beletsky ..... 224/243
6,112,962 A * 9/2000 Matthews ..... 224/243
6,128,847 A * 10/2000 Langner ..... 42/106
2001/0032406 A1* 10/2001 Yirmiyahu et al. ..... 42/70.11
2003/0042279 A1* 3/2003 Locklear, III ..... 224/244
2005/0040195 A1* 2/2005 Lowe et al. ..... 224/243
2005/0268518 A1* 12/2005 Pikielny ..... 42/90
2006/0180620 A1* 8/2006 Senn et al. ..... 224/243
2006/0236583 A1* 10/2006 Pikielny ..... 42/85
2007/0163164 A1* 7/2007 Avrahami et al. ..... 42/87

* cited by examiner

C - C

METHOD FOR LOADING A PISTOL AND A HOLSTER

FIELD OF THE INVENTION

The present invention relates to safe-guarding equipment, namely to individual small firearms, in particular to the means of carrying them. The methods and compositions of embodiments of the present invention find use in the placement of various systems and sized weapons on the different parts of the body with and without carrying straps.

BACKGROUND OF THE INVENTION

A common method of getting a pistol ready for action requires the following actions to be performed: getting the pistol out of the holster, removing the safety lock, and drawing off the slide with the help of the other hand to send the cartridge from the cartridge clip into the cartridge chamber. It involves two hands and takes a long time.

Methods of getting pistols ready for action and the holster for portable firearms according to the patent RF N 2150648, M.Cl.6: F41C 33/00, published May 6, 1995 are known and they are taken as nearest analogue-prototypes.

According to the method described on pages 5-13 of the description and claim 14 of patent N 2150648, getting the pistol ready for action is carried out with the help of one hand by shifting the barrel of the pistol with respect to the sliding element (the slide) in the holster, which contains the case with the blocking device. The blocking device of the holster contains a supporting element with an actuating lever and fixing lever for the slide stop.

The muzzle of the firearm is placed on the fixing lever and the grip of the arm is put in the direction of the fixing lever to shift the barrel and to fix the hole for throwing away the cartridge shell on the arm at the level of the actuating lever. The actuating level is then inserted through the hole for cartridge shells into the cartridge chamber of the arm. Thus, the arm is fixed in the blocking device between the actuating lever of the cartridge chamber and the fixing lever at the muzzle. The safety lock must be removed before setting the pistol in the holster.

To get the firearms ready for action, the grip of the arms is first pressed to the fixing lever, making the clearance for the actuating lever to go out of the cartridge chamber. The firearm is then inclined to extract the actuating lever out of the cartridge chamber. The grip is kept pressed to the fixing lever to shift the barrel to open the cartridge chamber completely to insert the cartridge into it. The firearm is then taken out of the holster.

The holster for portable firearms taken as a prototype (see pages 5-24 of the description and claim 16 of patent N 2150648), comprises the case, the plate adjoining the case and the unit for the slide stop till the cartridge chamber is open completely and the cartridge is sent into it.

The above methods of getting firearms ready for action have the following drawbacks:

a long preparation is required for getting the firearms ready for action;

the holster is not very reliable;

a complicated curve trajectory of the hand movements is required, which requires thorough mastering of movement coordination.

Additional drawbacks of the above described holster for portable firearms is that its design reduces the reliability of the pistol because it is impossible to fix the pistol when the cartridge is in the cartridge chamber since the magazine and any cartridges, which are in the cartridge chamber, must be first removed from the recess for the magazine. In addition because the cartridge chamber is open, it is possible for foreign objects to get into it. Recoil spring of the slide and the spring of the hammer when keeping the arms in the holster is constantly in the pressed state, which reduces the reliability of the pistol.

SUMMARY OF THE INVENTION

Embodiments of the present invention rectify the above drawbacks, namely, in reducing the time of getting the pistol ready for action when taking it out of the holster with the help of only one hand, increasing the reliability of the pistol, and in simplification of mastering coordination of movements of the shot.

The technical result is achieved through the following solutions.

A method of getting the pistol ready for action with the help of one hand comprises shifting the barrel of the pistol about the slide in the holster, containing the unit for slide stop until the cartridge chamber is completely open and the cartridge is set into it. Switching over the safety lock and shifting the barrel is carried out by one hand rectilinear pushing the pistol through the holster with a groove made for the grip of the pistol and a means for switching over the safety lock.

Options of the holster are offered to realize the method of getting the pistol ready for action with the help of only one hand.

In a first option, the holster for the pistol contains a case, wherein the base of the case is provided with guides for the slide. In some embodiments, it has in its cross section a shape of an arch with formation of a through groove along the case for the grip of the pistol and to provide advancement of the pistol in the case to get it ready for action while taking it out of the holster. At the end of the case, at the front cut there is a hole made for the barrel. Moreover, the case includes a means to switch the safety lock over. In some embodiments, the means to switch the safety lock is made on its lateral wall in the form of a figured window shaped as a one-sided trapezium.

In addition, in the central part of the case of the holster, made in conformity with the base of the case, the lateral side in the area of the pistol where the hole to throw away the cartridge cases is located, there is a hole to throw away the cartridge.

In some embodiments, the holster is supplied with an element to fit it on the belt.

In a second option, the holster for the pistol contains a case, wherein the case comprises guides for the slide. In some embodiments, it has in its cross section a shape of an arch with a groove along the case for the grip of the pistol and to provide advancement of the pistol in the case to get it ready for action while taking it out of the holster. At the front end of the case, on the lateral wall from the side of the safety lock there is a spring-loaded latch made in the form of a plate with the option of turning it along the direction of the movement of the pistol. In some embodiments, there is further provided a means to switch over the safety lock in the form of a figured window in the shape of a one-sided trapezium. In some embodiments, there is a supporting lug for the frame of the pistol, the length of which exceeds the maximum size of the figured window along the other wall of the case in its base from the inner side symmetrically about the figured window.

In the holster of the second option the corners of the figured window are made round.

In addition, in the central part of the case of the holster of the second option, on the lateral side proximal to the hole on the pistol to throw away the cartridge cases, a hole is made to throw away the cartridge.

In the holster of the second option the corners of the lug are made round.

The holster in conformity with the second option is optionally supplied with an element to fix it on the belt.

The present invention provides a method of getting a pistol ready for action with the help of one hand. In some embodiments, the method comprises switching over the safety lock and shifting the barrel of the pistol using one hand that rectilinearly pushes the pistol through in the holster, which has a groove for the grip of the pistol and the means to switch over the safety lock. This simplifies and accelerates the process of getting the pistol ready for action, since the trajectory of the hand movement is not curved, but straightforward-rectilinear; "forward-backward" with respect to the case of the holster.

The safety lock is switched over by shifting the pistol in respect to the case of the holster, the cartridge is sent further by shifting the lock frame, which increases the reliability of the process of getting the pistol ready for action.

The fact that the case of the holster is supplied (by the first option) in its base with the guides for the slide and that its cross section is made in the shape of an arch with formation of through groove along the case for the grip of the pistol ensures short time and accuracy of rectilinear advancement of the pistol in the case to get it ready for action while taking it out of the holster. In addition, the option of keeping the pistol in the holster without lateral shift is provided.

Providing the hole for the barrel (by the first option of the holster) at the end of the case, at the front cut and providing the case with a means to switch the safety lock over made on it lateral wall from the side of the safety lock in the form of a figured window as a one-sided trapezium allows one to release the safety lock of the pistol when moving the pistol in the holster in respect to the slide.

Providing the hole to throw away the cartridge (by the first option of the holster) in the central part of the case, on the lateral side, proximal to the hole for throwing the cartridge shells, provides a convenient location for throwing away the cartridge from the cartridge chamber and the holster.

The fixing element of the holster (by the first and second options) allows for fixing the holster with the belt in the required place.

The fact that the case comprises (by the second option) guides for the slide in the base and a cross section made in the shape of an arch with formation of a through groove along the case for the grip of the pistol ensures a short time and accuracy of rectilinear advancement of the pistol in the case to get it ready for action while taking it out of the holster.

The option of keeping the pistol in the holster without lateral shift is further provided is such a configuration.

Providing the spring-loaded latch (by the second option) at the front end on the lateral wall of the case, at the side of the safety lock in the form of a plate with the option of turning it along the direction of the movement of the pistol, provides fixation of the pistol in the holster.

Providing the means to switch over the safety lock (by the second option of the holster) in the form of a figured window in the shape of a one-sided trapezium, allows one release the safety lock of the pistol when moving the pistol in the holster.

Providing the supporting lug (by the second option of the holster) for the frame of the pistol on the opposite wall of the case at the inner side in its base, symmetrically about the figured window, with the length exceeding the maximum size of the figured window, allows for releasing the slide being in its limiting position and avoids jamming of the slide in case the cartridge is left in the cartridge chamber.

Making the corners of the figured window round (by the second option of the holster) ensures smoothness of movement of the pistol in the holster.

Making the hole (by the second option of the holster) in the central part of the case, on the lateral side of the area of location of the hole on the pistol to throw away the cartridge shells allows for a convenient method of throwing away the cartridge from the cartridge chamber and the holster.

The claimed method of getting the pistol ready for action with the help of only one hand and holster that provides for such a method ensure a reducing time for getting the pistol ready for action when taking it out of the holster using only one hand, and also increases reliability of the pistol and simplifies coordination of hand movements of the shot.

The inventions offered have a common inventive conception, namely: getting a pistol ready for action when it is being taken out of the holster using one hand. Complete preparation takes place during one cycle, including pushing the pistol through the holster by one movement of the hand forward or by forward-backward" movements of the hand. When the pistol is taken out of the holster, it is completely ready for action.

Quickness of getting the pistol ready for action with the help of one hand allows one to prepare the firearms quickly when a sudden attack takes place (e.g., by guards, bodyguards, and collectors) and in difficult situations, for example, when the second hand is blocked by the enemy, when it is used to hold something, if it is injured, when driving a car and so on.

Prior to the present invention, there were no similar technical solutions. The present invention provides a novel and non-obvious technical solution.

The claimed method of getting the pistol ready for action with the help of only one hand and the options of the holster for its realization can be used in safeguarding activity, for example, protection of collectors. Materials and equipment necessary to manufacture the offered options of the holster are commercially available. Therefore, the technical solutions claimed comply with the criterion of "industrial applicability".

DESCRIPTION OF THE DRAWINGS

The essence of the offered technical solution is made clear with the drawings, where.

DETAILED DESCRIPTION OF THE INVENTION

The method of getting the pistol ready for action is realized in the following way:

switching over the safety lock and shifting the barrel of the pistol in respect of the case of the holster is carried out by rectilinearly pushing the pistol through the holster which contains a groove for the grip of the pistol and the means for switching the safety lock over with one hand. Pushing the pistol through the holster is carried out either with forward and reverse movement back and forth or with a forward movement. Finally, the cartridge is sent further by shifting the slide frame;

Realization of the method of getting the pistol ready for action with help of only one hand occurs using a holster made by one of two options.

Figure 1:
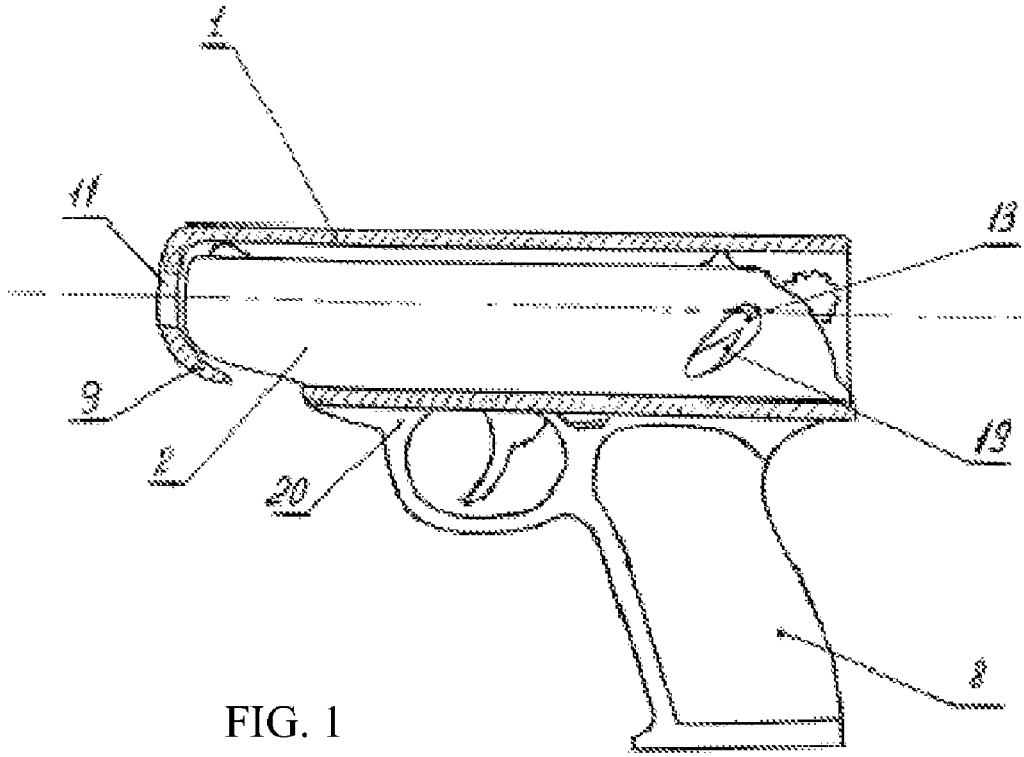
FIG. 1 shows the pistol in a holster is according to the first option (before loading).
Figure 2:
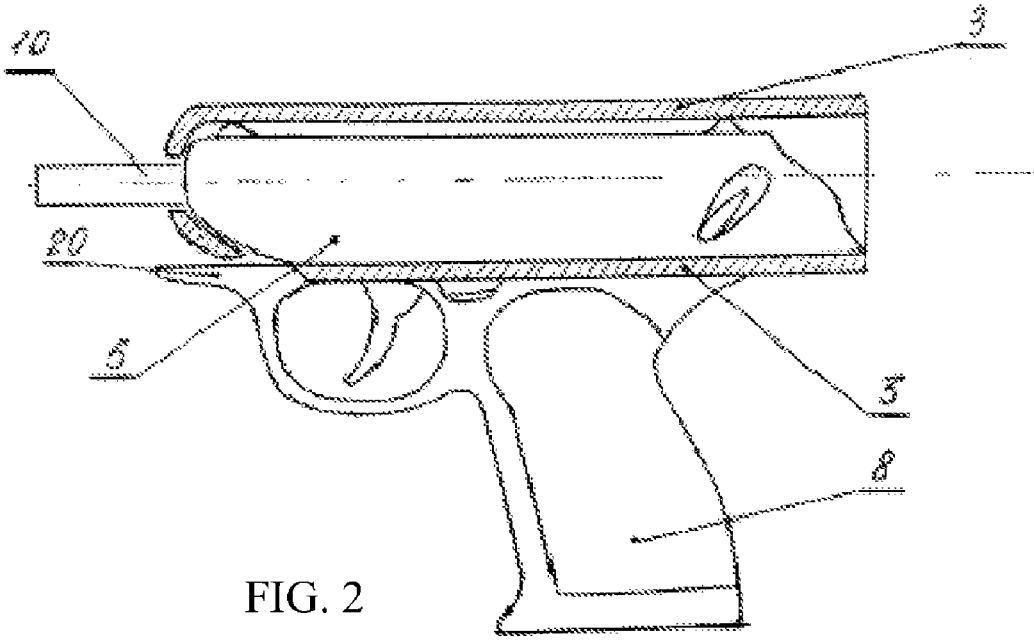
FIG. 2 shows the pistol in the holster is according to the first option (when it is being loaded).

By the first option. Referring to the Figures, the holster 1 for the pistol 2 is a case 3 is manufactured from plastic material or duralumin with the element to fix the holster on the belt (it is not shown on the drawing of FIG. 1).

The case 3 in the base is supplied with the guides 4 for the slide 5. It has in its cross section the form of an arch 6. Along the case 3 there is a through groove 7 for the grip 8 to enable the advancement of the pistol 2 in the case 3 and to get it ready for action when it is being taken out of the holster 1. At the end 9 of the case 3, at the front cut of the barrel 10 there is a hole 11 made for the barrel 10. On the lateral wall of the case 3 at the side of the safety lock 13, there is a gear to switch the safety lock 13, made in the form of the figured window 14 as one-sided trapezium.

Figure 5:
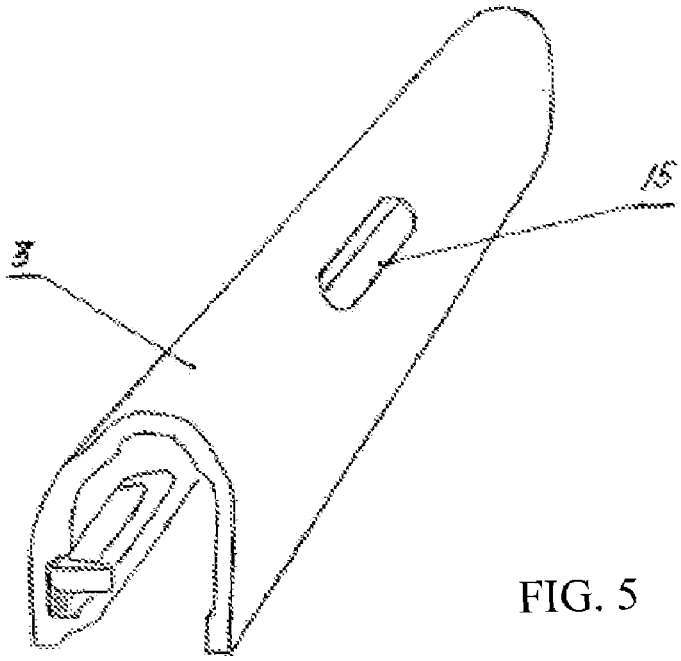
FIG. 5 shows a general isometric view of the holster according to the first option.
Figure 6:
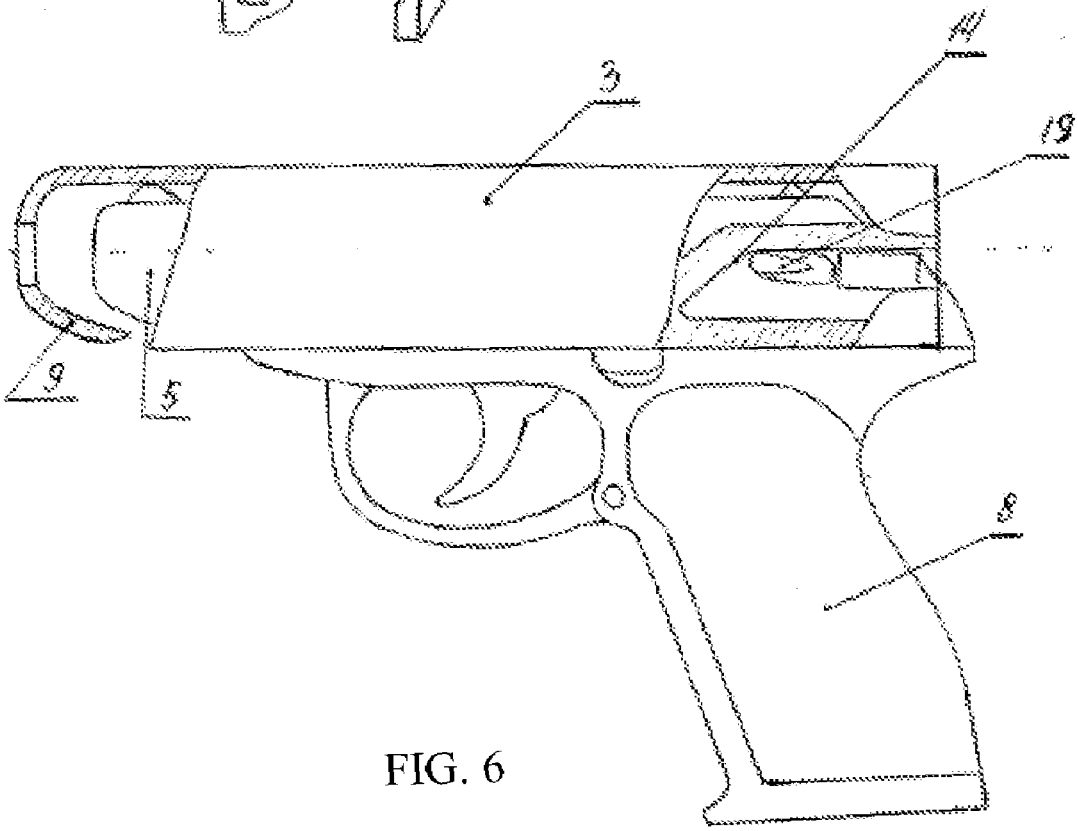
FIG. 6 shows the position of the pistol in the holster according to the first option with the figured window and the latch.

In the central part of the case 3 on the lateral side, in the area of location on the pistol 2 the hole for throwing the shells, there is a hole 15, made to throw the cartridge away, in case there is a cartridge left in the cartridge chamber (it is shown in FIG. 5 on the holster by the first option). To send the cartridge further out of the charger (or magazine) into the cartridge chamber by the pressure of the hand, the pistol 2 is advanced forward, the barrel 10 of the pistol 2 goes into the hole 11, and the lock 5 of the pistol 2 is supported by the end 9 of the case 3. After that the pistol 2 is taken out of the holster 1 by one movement of the hand backwards. The proposed design of the holster allows by a short movement of the hand "forward-backward" to get the safety lock 13 in the position "ready for action", to perform sending the cartridge out of the charger (or magazine) into the cartridge chamber, and to take the pistol 2 out of the holster 1.

Figure 3:
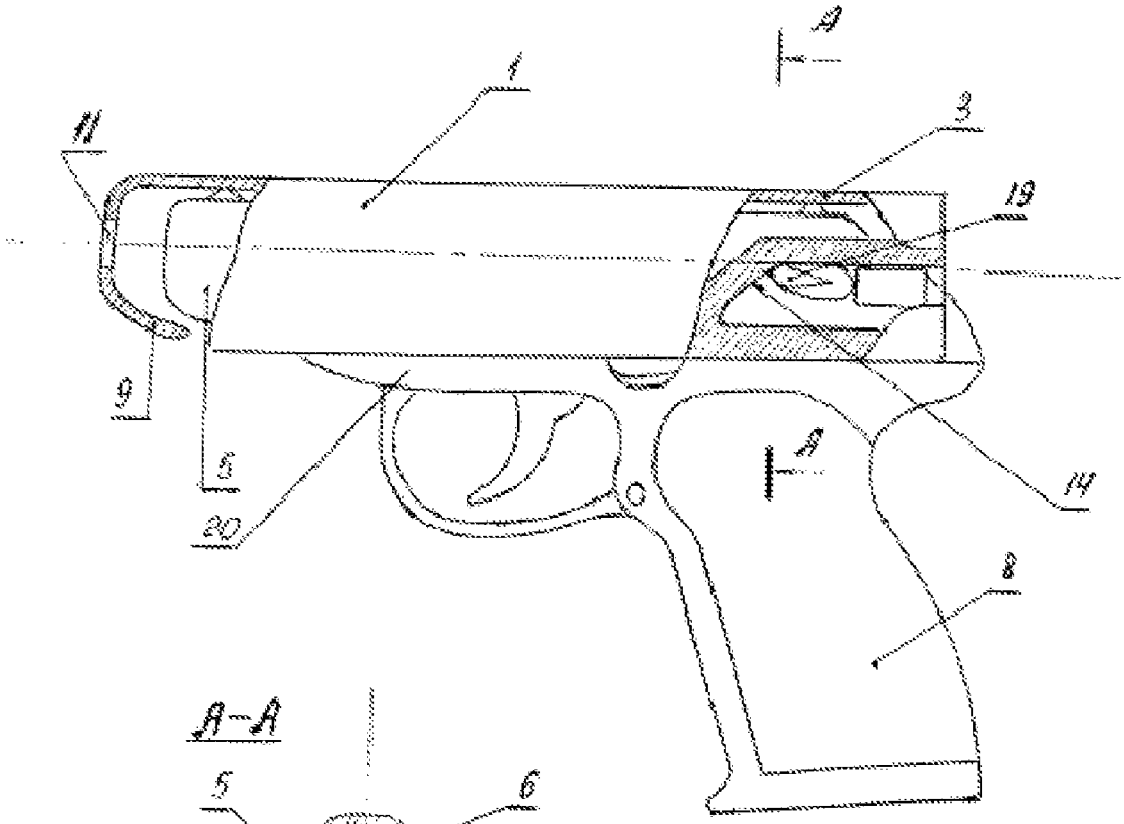
FIG. 3 shows a general view of the pistol in the holster according to the first option and a unit for switching over the safety lock.
Figure 4:
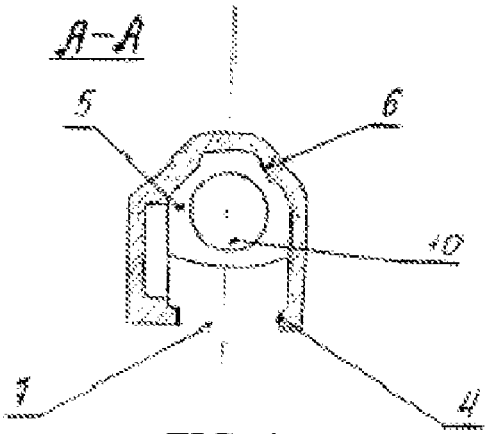
FIG. 4 shows a view as shown by A-A in FIG. 3.

Getting the pistol 2 ready for action and taking it out of the holster 1 by the first option is realized in the following way. When putting the pistol 2 down into the holster 1 with translation movement of the hand forward with pressure on the grip 8, the pistol 2 is advanced forward and shifted about the case 3 of the holster 1. The flag 19 of the safety lock 13 runs onto the tilted lateral side of the figured window 14, which turns the flag 19 down, switching the pistol over into the position "ready for action". After the safety lock 13 is switched over and the pistol 2 advances forward, the slide 5 remains in its place, because it is held with the figured window 14 and the slide frame 20 (FIG. 3) moves forward. The front part of the slide 5 rests upon the holster 1, as the hole in the holster 1 is made for the barrel.

With movement of the hand forward in respect with the case 3 of the holster 1, the cartridge is sent further out of the charger (or magazine) into the cartridge chamber (it is not shown in the drawing). The pistol 2 is advanced forward and the slide frame 20 is shifted, the barrel 10 of the pistol 2 goes into the hole 11, and the breechblock 5 of the pistol 2 is held with the end 9 of the case 3. The pistol 2 is then taken out of the holster 1 by rectilinear reverse movement of the hand backward in respect with the case 3 of the holster 1.

The proposed design of the holster 1 by the first option allows with short forward and reverse movement of the hand "forward-backward" about the case 3 of the holster 1 to get the safety lock 13 in the position "ready for action", to further perform sending the cartridge out of the charger (or magazine) into the cartridge chamber and to take the pistol 2 out of the holster 1.

Figure 7:
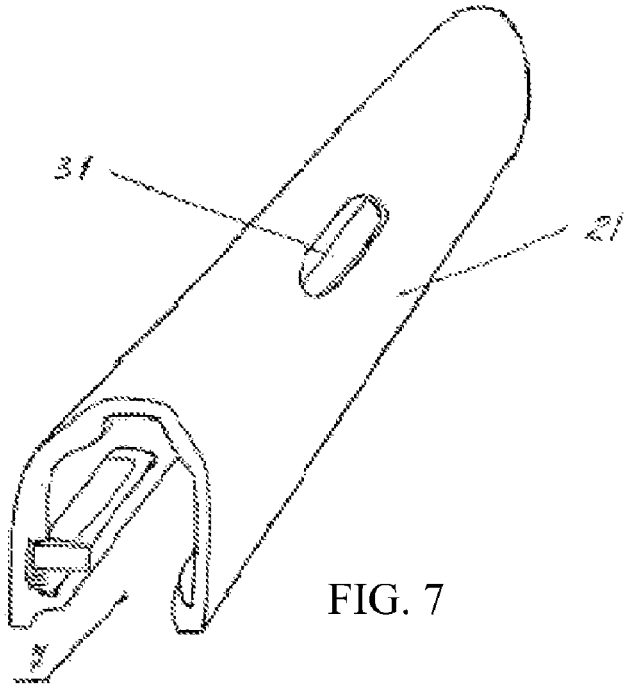
FIG. 7 shows a general isometric view of the holster according to the second option.
Figure 8:
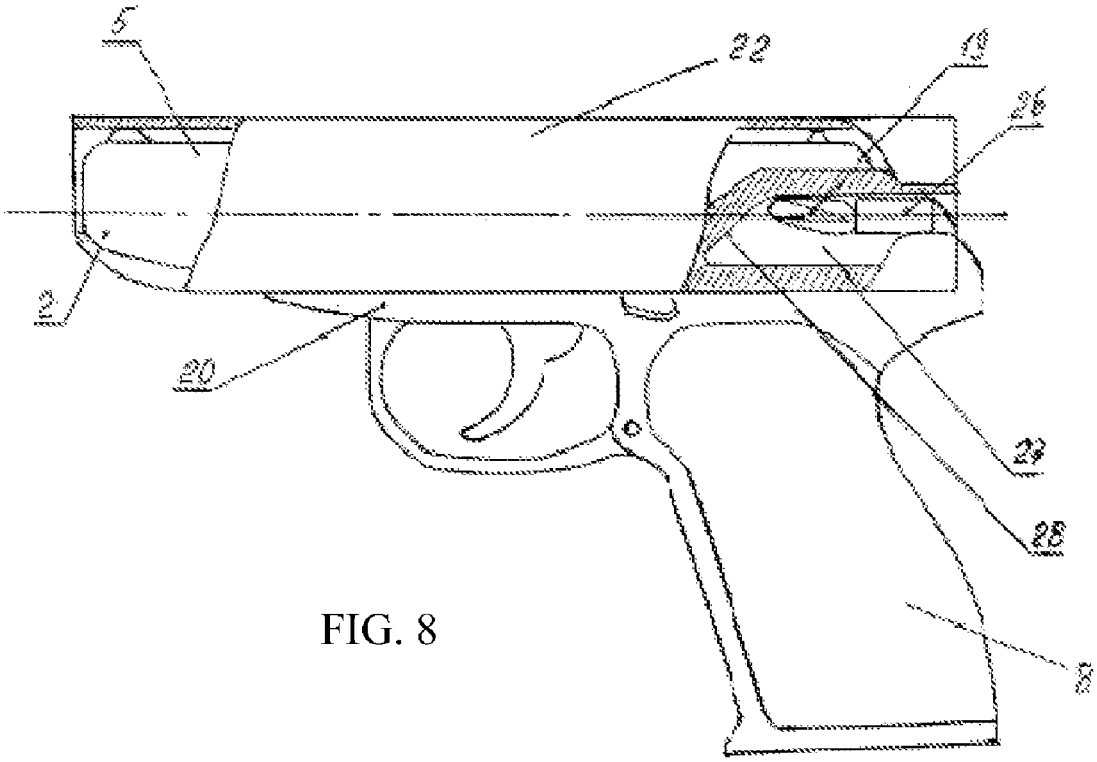
FIG. 8 shows a general view of the holster according to the second option with the elements of switching over and fixing.

By the second option. The holster 21 for the pistol 2 (FIG. 7) is a case 22 (FIG. 8) manufactured from plastic material or duralumin with the element to fix the holster 21 on the belt (not shown on the drawings of FIG. 7 or 8).

Figure 9:
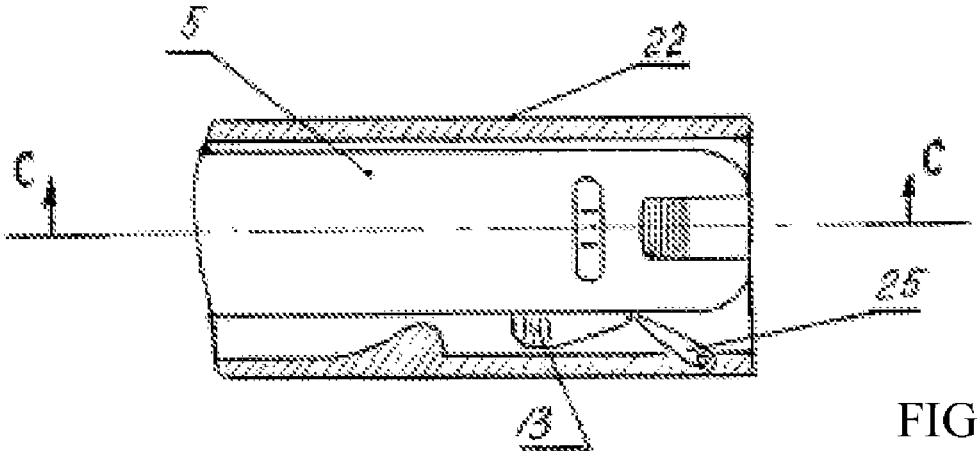
FIG. 9 shows the position of the latch and the safety lock before switching the safety lock over.
Figure 10:
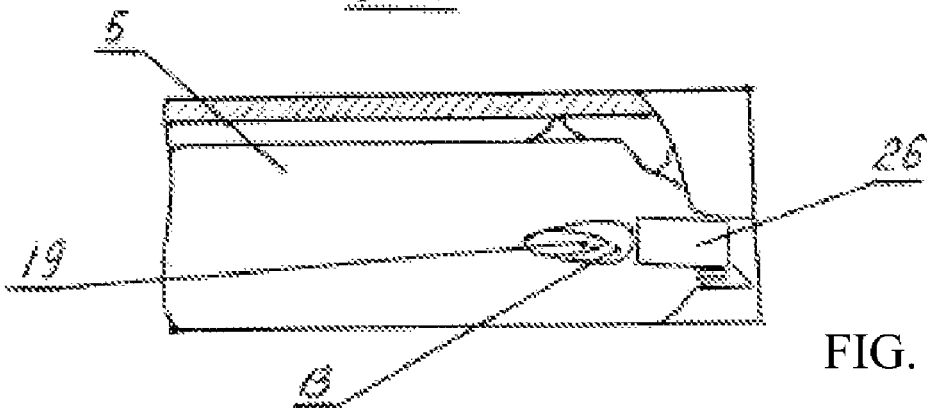
FIG. 10 shows a view as shown by C-C in FIG. 9.
Figure 14:
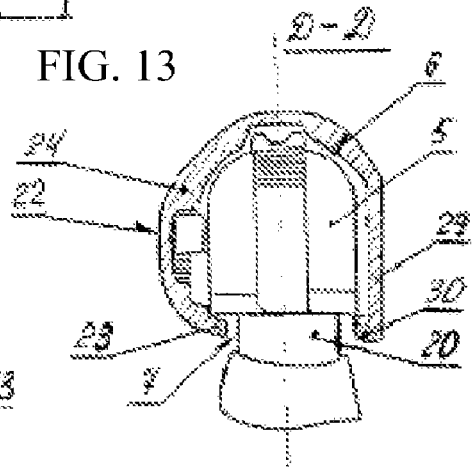
FIG. 14 shows a view as shown by D-D in FIG. 13.

The case 22 in its base is equipped with guides 23 (FIG. 14) for the slide 5. It has in its cross section a form of an arch 6 with the formation of the through groove 7 (FIG. 14) along the case 22 to push the pistol 2 through the case 22 when taking it out of the holster 21. At the front end of the case 22, on the lateral wall 24 (FIG 14) at the side of the safety lock 13 (FIG. 9) there is a spring-loaded latch 25 (FIG. 9) made with the possibility of its turning according to the movement of the pistol in the holster 21. The latch 25 is made in the form of a flat plate 26 (FIG. 10). The safety lock 13 and the latch 25 are made on the same line, which is parallel to the longitudinal axis of the case 22 (FIG. 10).

On the same lateral wall 24 of the case 22 (FIG. 14) there is a means made to switch over the safety lock in the form of a figured window 27 (FIG. 8) in the form of a one-sided trapezium: a figured window 27 with a tilted lateral side 28. On the other side 29 (FIG. 14) of the case 22 in its base from the inner side symmetrically to the figured window 27 there is a supporting lug 30 (FIG. 14) made for the slide frame 20 of the pistol. The length of the supporting lug 30 is more than the maximum size of the figured window 27. The corners of the figured window 27 and the lug 30 are rounded. In the central part of the case 22 on the lateral side in the area of the location of the window on the pistol to throw the cartridge cases away. Specifically, there is a window 31 made to throw the cartridge away in case there is a cartridge left in the cartridge chamber.

Getting the pistol ready for action and taking it out of the holster 21 according to the second option is carried out in the following way.

Figure 11:
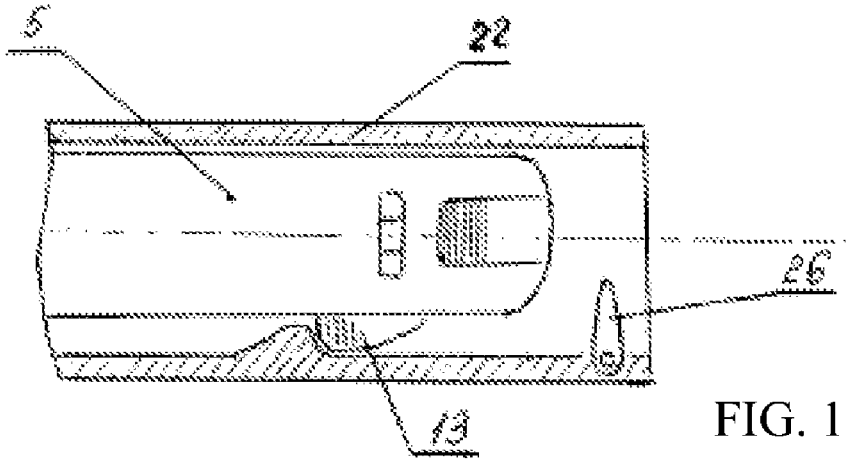
FIG. 11 shows the position of the latch after switching over the safety lock.
Figure 12:
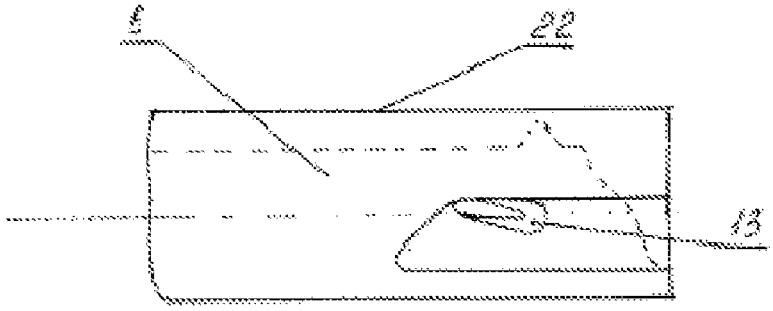
FIG. 12 shows the position of the flag of the safety lock in the window before switching it over.
Figure 13:
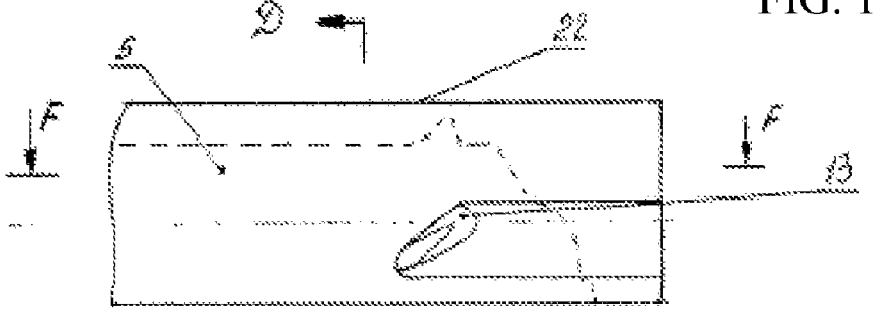
FIG. 13 shows the position of the flag of the safety lock in the window after switching it over.
Figure 15:
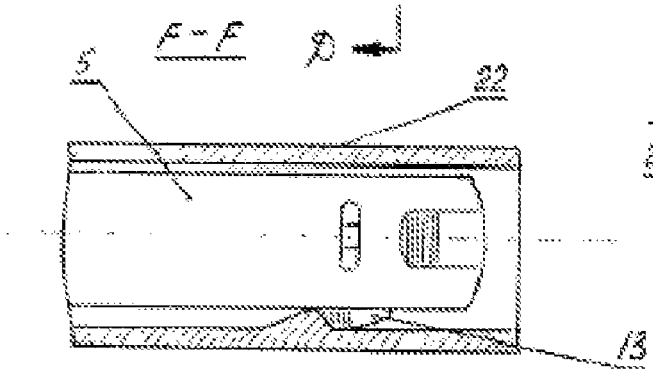
FIG. 15 shows a view as shown by F-F in FIG. 13.

When putting the pistol into the holster 21 the plate 26 of the latch 25 deviates according to the direction of the movement of the pistol, letting it into the holster 21, and at the end of the movement rests against the base of the flag 19 of the safety lock 13 (FIG. 9), presenting the movement of the pistol backward. The pistol turns to be fixed in the holster 21. With translation rectilinear movement of the hand forward in respect with the case 22 of the holster 21 the safety lock 13 is switched over, the plate 26 of the latch 25 is released and occupies the neutral position. Having such a position of the latch 25, the pistol can be easily taken out of the holster 21 (FIG. 11).

When the pistol is in the holster 21 it is safely fixed on the first stage from one side with the tilted lateral side 28 of the figured window 27, against which the flag 19 of the safety lock 13 rests. From the other side it is fixed with the lug 30 which rests against the slide frame 20 of the pistol. With translation rectilinear movement of the hand forward and pressing the grip 8, the pistol is advanced forward in the case 22 of the holster 21. The flag 19 of the safety lock 13 runs onto the tilted lateral side 28 of the figured window 27, which turns the flag 19 dawn (FIG. 8) switching the pistol over into the position "ready for action".

After the safety lock 13 is switched over, when the pistol advances further forward, the slide 5 remains in its place, because it is held with the figured window 27 and the slide frame 20 moves forward. At the limiting position, when the cartridge has already been caught with the lug 30, the slide frame 20 will come off the supporting lug 30 and the slide 5 of the pistol will be able to move to the right and go out off the figured window 27 and, moving by the effect of the spring, to send the cartridge further into the cartridge chamber.

The suggested design of the holster 21 according to the second option allows one by translation rectilinear movement of the hand in respect with the case 22 of the holster 21 to get the safety lock 13 into the position "ready for action", to further send the cartridge out of the charger or a magazine into the cartridge chamber and to take the pistol 2 out of the holster 21.

Examples of particular executions of the method of getting the pistol ready for action with the help of one hand according to the first and the second options of the holster are given below.

Getting the pistol ready for action with the help of only one hand according to the first option of the holster is realized in the following way.

When putting the pistol 2 down into the holster 1 with translation rectilinear movement of the hand forward in respect with the case 3 of the holster 1 with pressure on the grip 8, the pistol 2 is shifted about the case 3 of the holster 1.

Shifting the pistol 2 about the case 3 of the holster 1 switches over the safety lock 13 because the flag 19 runs onto the tilted lateral side of the figured window 14 (FIG. 3), turning the flag 19 down and switching the pistol 2 over into the position "ready for action". In further rectilinear, translation movement of the hand forward, and therefore, the advancement of the pistol 2 forward, the slide 5 remains in its place, because it is held with the figured window 14 and the slide frame 20 moved forward. With further translation movement of the hand forward, the cartridge is sent further out of the charger (or magazine) into the cartridge chamber because of the advancement of the pistol 2 forward and shift of the slide frame 20.

The barrel 10 of the pistol 2 goes into the hole 11, and the breechblock 5 is held with the end 9 of the case 3. The pistol 2 is taken out of the holster 1 by rectilinear reverse movement of the hand backward in respect with the case 3 of the holster 1.

The method provides switching over the safety lock 13 in the position "ready for action", sending the cartridge out of the charger into the cartridge chamber and taking the pistol 2 out of the holster 1 due to translation and reverse rectilinear short movement of the hand "forward-backward".

Getting the pistol ready for action with the help of only one hand according to the second option of the holster is realized in the following way.

When putting the pistol 2 into the holster 21 the plate 26 of the latch 25 deviates according to the direction of the movement of the pistol 2, letting it into the holster 21, and at the end of the movement resting against the base of the flag 19, preventing the movement of the pistol 2 backward. The pistol 2 is fixed firmly in the holster 21.

To get the pistol ready for action, translation rectilinear movement of the hand forward is made in respect with the case 22 of the holster 21 and pressing the grip 8, the pistol 2 is shifted about the case 22 of the holster 21 and the safety lock 13 is switched over. In further translation movement of the hand forward, the slide 5 remains in its place and the slide frame 20 moves forward. At the limiting position, when the cartridge is caught with the slide 5, the slide frame 20 goes off the supporting lug 30 and the slide 5 of the pistol 2 moves to the right, goes out off the figured window 27 and, moving by the effect of the spring, sends the cartridge further into the cartridge chamber.

The method provides switching over the safety lock 13 in the position "ready for action", further sending the cartridge out of the charger into the cartridge chamber and taking the pistol 2 out of the holster 21 due to translation rectilinear short movement of the hand in respect with the case 22 of the holster 21 in one direction—forward.

The applicant carried out experimental tests of the specimens of the holster, produced using the offered inventions. The tests showed good results concerning the speed of taking the pistol out of the holster in any position: standing, sitting, lying and its location on different parts of the body both using the carrying straps and without them. The carrying straps allow one to wear the holster on the waist, on the leg, on the chest, under one's arm.

Thus, application of the inventions offered results in a reduction of the time to get the pistol ready for action when taking it out of the holster with the help of only one hand, high reliability of the pistol, and simplification of coordination of movements of the shot. This provides the possibility of wide application of the technical solutions claimed in safeguarding equipment.

We claim:

1. A holster for a firearm having a barrel, a slide, a breechlock and a safety, comprising:

a case comprising an elongated member forming an arch in cross section and having a longitudinal axis, said elongated member having therein a groove parallel to said longitudinal axis and on each side of said arch for gripping said firearm, said case having an end having an opening therein through which said barrel can extend, wherein said end is sized so that said breechlock is held within said end when said firearm is moved forward in said case and said barrel extends through said opening, said case further having therein a gear comprising a surface that engages said safety so that when said firearm is moved forward in said case said safety is released so that firearm can be fired.

2. The holster of claim 1 wherein said case further ocmprises a window configured for ejection of cartridges.

3. The holster of claim 2, wherein said window is located on a lateral side of said case.

4. The holster of claim 1, wherein said holster further cmoprises an element to fix said holster to a user.

5. A holster for a firearm having a barrel, a slide, a breechlock and a safety, comprising:

a case comprising an elongated member forming an arch in cross section and having a longitudinal axis, said elongated member having therein a groove parallel to said longitudinal axis and on each side of said arch for gripping said firearm, said case having an end having an opening therein through which said barrel can extend, wherein said end is sized so that said breechlock is held within said end when said firearm is moved forward in said case and said barrel extends through said opening, said case further having therein a gear comprising a surface that engages said safety so that when said firearm is moved forward in said case said safety is released so that the firearm can be fired; and a spring-loaded latch attached to said case, said latch configured for turning along the direction of the movement of the pistol; and a supporting lug that accommodates the slide of said firearm.

6. The holster of claim 5, wherein said lug is rounded.

7. The holster of claim 5, wherein said case further comprises a window configured for ejection of cartridges.

8. The holster of claim 7, wherein said window is located on a lateral side of said case.

9. The holster of claim 5, wherein said holster further cmoprises an element to fix said holster to a user.

10. A method of getting a firearm having a barrel, a slide, a breechlock and a safety ready for firing using one hand, comprising:

a) providing a holster, wherein said holster comprises a case, said case comprising an elongated member forming an arch in cross section and having a longitudinal axis, said elongated member having therein a groove parallel to said longitudinal axis and on each side of said arch for gripping said firearm, said case having an end having an opening therein through which said barrel can extend, wherein said end is sized so that said breechlock is held within said end when said firearm is moved forward and in said case and said barrel extends through said opening, said case further having therein a gear comprising a surface that engages said safety so that when said firearm is moved forward in said case said safety is released so that the firearm can be fired b) shifting the barrel of said firearm about said slide in said holster, until the cartridge chamber is completely open and the cartridge is sent into it, wherein switching over the safety lock and shifting the barrel are carried out by rectilinear pushing through the pistol with one hand in said holster.

* * * * *